US008640871B2

(12) United States Patent
Moss

(10) Patent No.: US 8,640,871 B2
(45) Date of Patent: Feb. 4, 2014

(54) STACKABLE MERCHANDISE TRAYS

(76) Inventor: Geoffrey Alan Moss, Maple (CA)

( * ) Notice: Subject to any disclaimer, the term of this patent is extended or adjusted under 35 U.S.C. 154(b) by 148 days.

(21) Appl. No.: 13/136,141

(22) Filed: Jul. 26, 2011

(65) Prior Publication Data

US 2013/0026060 A1 Jan. 31, 2013

(51) Int. Cl.
*B65D 21/032* (2006.01)
*B65D 85/62* (2006.01)

(52) U.S. Cl.
USPC ..... 206/512; 206/511; 206/509; 229/918

(58) Field of Classification Search
USPC ..... 206/512, 511, 509; 229/918; 220/516
See application file for complete search history.

(56) References Cited

U.S. PATENT DOCUMENTS 2,707,587 A * 5/1955 Wittstein ..... 229/125.19
4,923,113 A * 5/1990 Guijarro ..... 229/125.27
5,535,941 A * 7/1996 Garza ..... 229/191
6,568,588 B2 * 5/2003 Holdsworth et al. ..... 229/164
6,712,214 B1 * 3/2004 Wintermute et al. ..... 206/745
6,938,820 B2 * 9/2005 Noone et al. ..... 229/176
7,637,372 B2 * 12/2009 Keel et al. ..... 206/509
7,669,754 B2 * 3/2010 Casanovas et al. ..... 229/117.03
2006/0038000 A1 * 2/2006 Sheffer ..... 229/164
2006/0138205 A1 * 6/2006 Keefe et al. ..... 229/179
2007/0051789 A1 * 3/2007 Panduro et al. ..... 229/175

* cited by examiner

*Primary Examiner* — Anthony Stashick
*Assistant Examiner* — Jennifer Castriotta
(74) *Attorney, Agent, or Firm* — David W. Wong

(57) ABSTRACT

Rugged stackable merchandise tray containers are provided with right-angled mounting tabs at the inner corners of the top panel of two load supporting casing formed at the two ends of the tray container. The right-angled mounting tabs are engageable with rectangular mounting openings formed at the bottom of the bottom panel when two tray containers are stacked one on top of another. The mounting provide resistance to accidental external impact exerted to the stack. At least one trapezoidal shape pull-out tabs are also provided at the edge portion of the bottom panel, which are engageable with aligned mounting slots formed at the top panel of the load supporting casings to provide further securement of the stacked tray containers as well as enhanced resistance to external impact to the stack.

8 Claims, 12 Drawing Sheets

STACKABLE MERCHANDISE TRAYS

BACKGROUND OF THE INVENTION

1. Field of the Invention

This invention relates to merchandise containers for transporting, storing and display merchandise, and particularly to tray containers which can be stacked together securely to withstand accidental external impact.

2. Background Art

Containers made of corrugated board or cardboard are commonly employed for transporting and for storage of merchandise. However, most containers are not suitable for displaying the merchandise at the sale or retail location, since the merchandise is not readily accessible from the container by customers for selecting the items to purchase. Accordingly, the merchandise, after transported to the sale or retail location, must be unpacked from the containers and be transferred to display shelves, stands, or show cases in order that customers may select the items to purchase. This procedure is time consuming and labor intensive to carry out.

Containers can be made in the form of trays which can be employed for the same purposes for storage and transport as well as for displaying the merchandise readily at the retail destination so as to reduce the amount of time required for handling and re-arranging of the merchandise at the retail location. A plurality of trays can be stacked in a transporting vehicle during transport or in the warehouse during storage in order to utilize the available space efficiently. Thus, special construction must be provided in the tray to ensure that a plurality of it can be securely stacked together and withstand accidental external impact thereto. Some trays are provided with upstanding tabs at the outer corners of the top of the tray which are aligned with bottom slots formed at the bottom panel of the tray, so that a plurality of trays can be stacked together securely with the upstanding tabs of the bottom tray engaging with the aligned bottom slots of the tray at the top. Also, right-angled corners may be formed at the outer corners of the side panels of the tray so that trays can be stacked together with the upstanding right-angled corners of the tray at the bottom engaging with lower corner recesses formed in the bottom portion of the side panel of the tray at the top for holding the trays together.

In known tray containers, such as that shown in U.S. Pat. No. 5,330,094 issued on Jul. 19, 1994 to Noel J. Mertz, four right-angled upstanding corners which are small in dimensions, short in height, and complex and yet unreliable in construction are provided at the upper edge of an outer cover panel of the side panels of the tray with the securement provided at the outer surface of the side panels. When two tray are stacked together, the upstanding right-angled upstanding corners of the tray at the bottom engage with the bottom corner recesses of the outer cover panels of the tray at the top to retain the trays stacked together. However, due to the small dimensions and the unprotected upstanding right-angled corners, the upstanding right-angled corners are readily deformed or mutilated during stacking of the trays or they are destroyed by impact during moving of the stack in handling or in transportation. Furthermore, the upstanding right-angled corners are an extension portion of the upper edge of the outer cover panels, and the cover panels are secured to the outer surface of the side walls of the tray with tabs inserting into slots formed in the outer surface of the side walls of the tray. When the stack of the trays is subject to accidental lateral impact it would cause the merchandise in the tray to shift due to the inherent inertia force. The force due to the shifting weight of the merchandise contained therein as well as from the external impact with other objects particularly during handling and transportation, the force would invariably exert a lateral pushing force at the right-angled corners. As the right-angled corners are part of the extensions folded over the side walls, the pushing force would cause the securement tabs of the covering panels to disengage from the side walls of the tray, thus resulting in the loss of securement between the stacked trays. Moreover, the folded extension portions cover over the outer surface of the side walls of the tray such that the side walls may not be provided with graphic matters for merchandising purposes.

SUMMARY OF THE INVENTION

It is a principal object of the present invention to provide a tray container for the storage, transportation, as well as display purposes of merchandise without having to rearrange the merchandise at the retail location.

It is an object of the present invention to provide a tray container having interlocking tabs and an associate mounting openings such that a plurality of it may be securely stacked together without being dislodged or destroyed by external forces during handling and transportation.

It is another object of the present invention to provide a tray container having a relatively simple construction and may be easily assembled by forming a unique configuration on a standard size cardboard stock or the like with minimal wastage of the cardboard stock.

It is another object of the present invention to provide a tray container having a rugged construction.

It is yet another object of the present invention to provide a tray container having completely flat outer side walls suitable for providing graphic matter thereon for merchandising purposes.

BRIEF DESCRIPTION OF THE DRAWINGS

Other objects of the invention will become apparent in the following description and appended claims, reference being made in the following accompanying drawing forming a part of the specification:

DETAILED DESCRIPTION OF THE PREFERRED EMBODIMENTS

Figure 3:
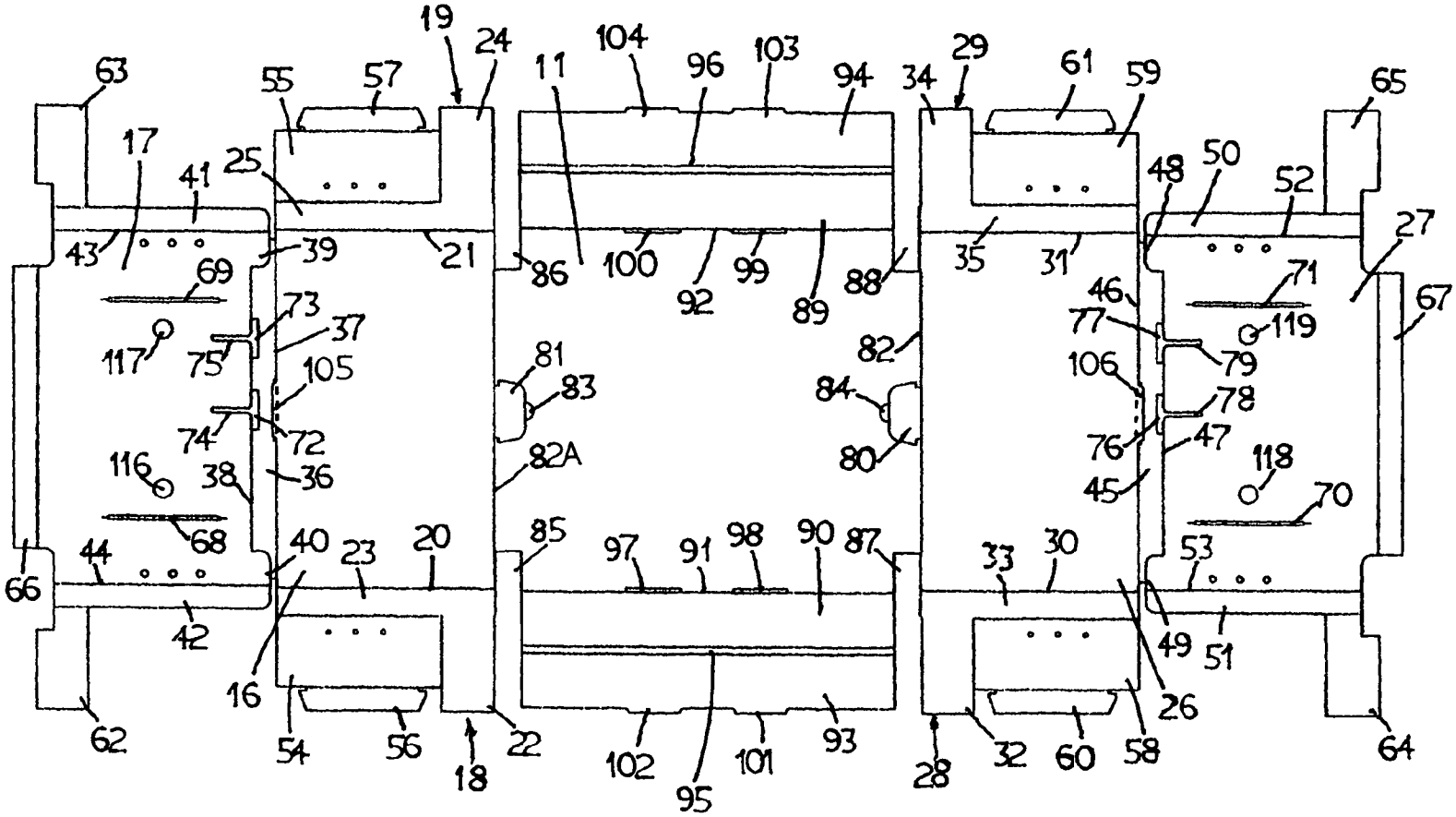
FIG. 3 is a top perspective elevation view showing the geometrical figure formed on a single cardboard stock for fabricating the tray container of the present invention.

With reference to the drawings in which like reference numerals designate corresponding parts in the different views, the tray container 10 according to the present invention has a generally lateral U shape with a rectangular bottom panel 11. A rectangular front panel 12 having a low height extends upwards from the front edge of the bottom panel 11, and an equally low height rectangular rear panel 13 extends upwards from the rear edge of the bottom panel 11. The low height front and rear panels 12 and 13 facilitate easy visibility and access to and the merchandise located in the tray container from either the front or rear thereof. A generally rectangular weight supporting and reinforcement left case 14 is located vertically upwards from the left side edge portion of the bottom panel 11, and an equal rectangular weight supporting and reinforcement right case 15 is located vertically upwards from the right side edge portion of the bottom panel 11. The left case 14 has a completely flat outer panel which forms the left outer side panel 16 of the tray container. Similarly, the right case 15 also has a completely flat outer panel which forms the right outer side panel of the tray container. The left case 14 has an inner panel which forms the inner left side panel 17 of the tray container. The tray container 10 may be fabricated with a geometric figure as best shown in FIG. 3 provided on a single sheet material such as a cardboard or corrugated board stock. The geometric figure can be stamped or cut from the sheet material and assembled to form the tray container 10. As shown in FIG. 3, the left outer side panel 16 has a generally L-shaped front extension panel 18 and a similar generally L-shaped rear extension panel 19 which are foldable relative to the front edge 20 and rear edge 21 respectively of the left outer side panel 16. The L-shaped front extension panel 18 has a shorter arm portion 22 and a longer arm portion 23 perpendicular to one another with the longer arm portion 23 located adjacent to the front edge 20 of the left outer side panel 16. The L-shaped rear extension panel 19 has a shorter arm 24 and a longer arm portion 25 perpendicular to one another with the longer arm portion 25 located adjacent to the rear edge 21 of the left outer side panel 16. Similarly, the right case 15 has an outer panel which forms the right outside side panel 26 of the tray container 10 and it also has a completely rectangular flat surface. The right case 15 has an inner panel which forms the inner right side panel 27 of the tray container. The right outer side panel 26 has a generally L-shaped front extension panel 28 and a similar generally L-shaped rear extension panel 29 which are foldable relative to the front edge 30 and rear edge 31 respectively of the right outer side panel 26. The L-shaped front extension panel 28 has a shorter arm portion 32 and a longer arm portion 33 perpendicular to one another with the longer arm portion 33 located adjacent to the front edge 30 of the right outer side panel 26. The L-shaped rear extension panel 29 has a shorter arm portion 34 and a longer arm portion 35 perpendicular to one another with the longer arm portion 35 located adjacent to the rear edge 31 of the right outer side panel 26.

Figure 1:
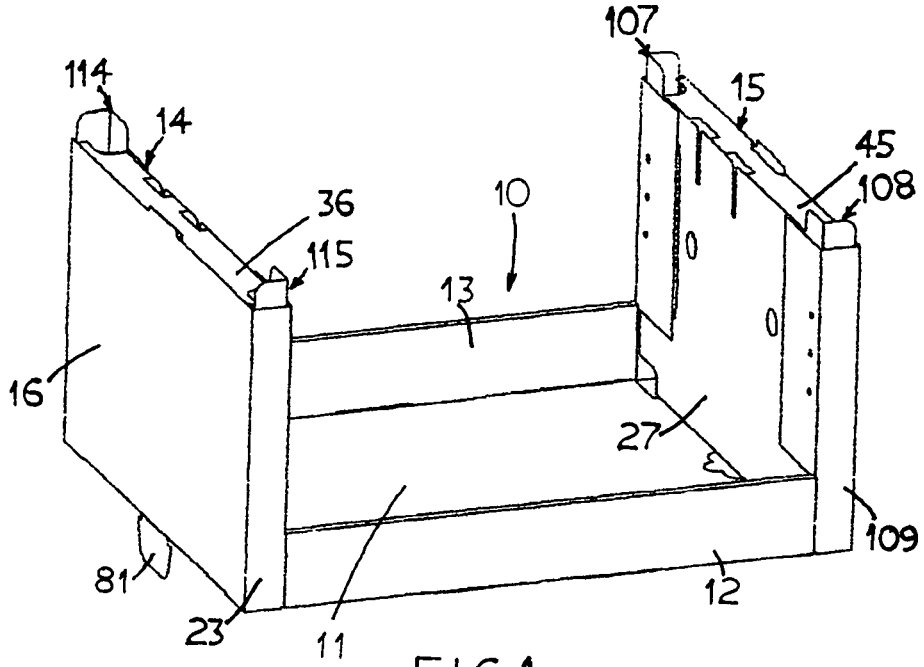
FIG. 1 is a front and top perspective elevation view of the tray container of the present invention.
Figure 2:
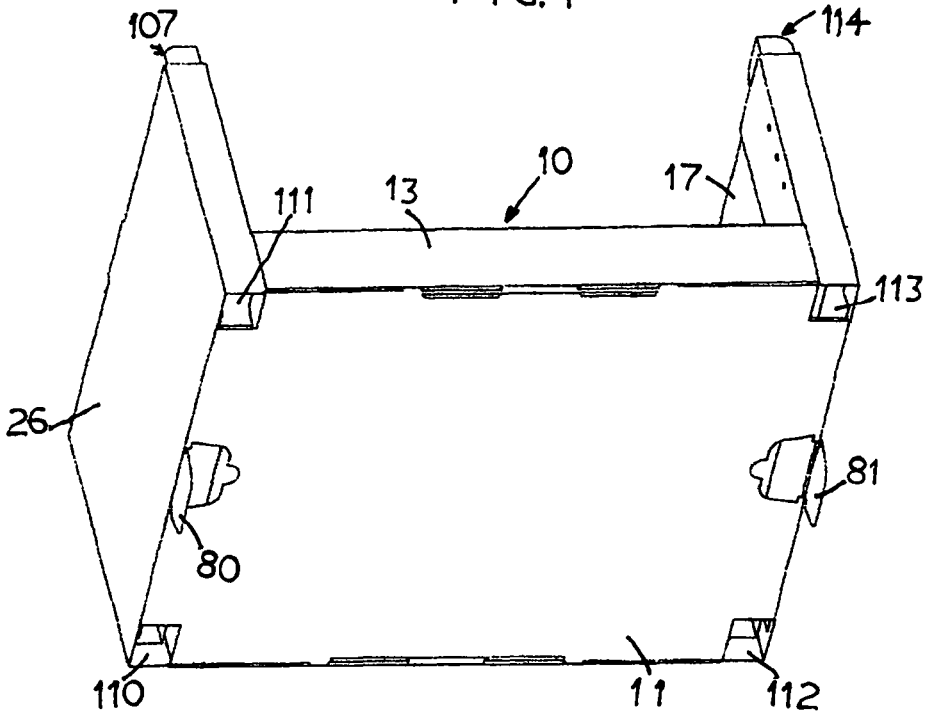
FIG. 2 is a front and bottom perspective elevation view of the tray container according to the present invention.

The left case 14 has a top panel 36 formed by a generally trapezoidal shaped panel located between the left outer side panel 16 and left inner side panel 17 and it is foldable relative to the outer left side panel 16 along a common edge 37, and foldable relative to the inner left side panel 17 along a common edge 38. The corner edge portions 39 and 40 of the common edge 38 extend a short distance into the top panel 36. Two narrow outer panels 41 and 42 extend outwards from the outer edges 43 and 44 of the left inner side panel 17. The height of the narrow outer panels 41 and 42 is equal to the height of the longer arm portions 25 and 23 of the L-shaped extension panels 18 and 19. When the left inner side panel 17 is folded along the common edge 38 to lie perpendicular to the top panel 38 after the narrow outer panels 41 and 42 having been folded to lie perpendicular to the left inner panel 17, two right-angled mounting tabs are invariably formed by the corner portions 39, 40 extending upward at the inner corners of the left casing 14 adjacent to the interior of the tray container as best shown in FIG. 1.

Similarly, the right case 15 has a top panel 45 formed by a generally trapezoidal shaped panel located between the right outer side panel 26 and the right inner side panel 27 and it is foldable relative to the outer right side panel 26 along a common edge 46 and foldable relative to the inner right side panel 27 along a common edge 47. The corner edge portions 48 and 49 of the common edge 47 extend a short distance into the top panel 45. Two narrow outer panels 50 and 51 extend outwards from the outer edges 52 and 53 of the right inner side panel 27. The height of the narrow outer panels 50 and 51 is equal to the height of the longer arm portions 33 and 35 of the L-shaped extension panels 28 and 29. When the right inner side panel 27 is folded along the common edge 47 to lie perpendicular to the top panel 45 after the narrow outer panels 50 and 51 having been folded to lie perpendicular to the right inner panel 27, two right-angled mounting tabs are formed invariably by the corner portion 48 and 49, extending upward at the inner corners of the right case 15 adjacent to the interior of the tray container as best shown in FIG. 1.

Two rectangular cover panels 54 and 55 extend outward from the outer side edges of the longer arm portions 23 and 25 of the left L-shaped extension panels 18 and 19; and two securing tabs 56 and 57 are formed at the outer edges of the rectangular cover panels 54 and 55 respectively. Similarly, two rectangular cover panels 58 and 59 extend outward from the outer side edges of the longer arm portions 33 and 35 of the right L-shaped extension panels 28 and 29; and two securing tabs 60 and 61 are formed at the outer edges of the two rectangular cover panels 58 and 59 respectively.

Two rectangular retaining arms 62 and 63 are formed at the outer edge portion of the narrow outer panels 41 and 42, of the left inner panel 17, and extending outward from the outer corners thereof. Similarly two rectangular retaining arms 64 and 65 are formed at the outer edge portion of the narrow outer panels 50 and 51, of the right inner panel, and extending outward from the outer corners thereof.

An abutment strip 66 is formed at the outer edge of the left inner side panel 17 and similarly an abutment strip 67 is formed at the outer edge of the right inner side panel 27.

Two mounting slots 68 and 69 parallel to the side edges 43 and 44 and spaced therefrom at a distance equal to the height of the rectangular cover panels 54 and 55 respectively are formed in the left inner side panel 17. The length of the mounting slots 68 and 69 is equal to the length of the securing tabs 56 and 57 respectively. Similarly, two mounting slots 70 and 71 parallel to the side edges 52 and 53 and spaced therefrom at a distance equal to the height of the rectangular cover panels 58 and 59 respectively are formed in the right inner side panel 27.

Two spaced T-shaped slots 72 and 73 are formed at the common edge 38 between the narrow top panel 36 and the left inner side panel 17. The T-shaped slots 72 and 73 have slot arms 74 and 75 respectively extending into the left inner side panel 17. Similarly, two spaced T-shaped slots 76 and 77 are formed at the common edge 47 between the narrow top panel 45 and the right inner side panel 27. The T-shaped slots 76 and 77 have perpendicular slot arms 78 and 79 respectively extending into the right inner side panel 27. The T-shaped slots 72 and 73 of the left casing are located directly opposite to the T-shaped slots 76 and 77 of the right casing respectively of the tray container.

Two trapezoidal shaped pull-out mounting tabs 80 and 81 are formed preferably at the middle portion of the side edges 82 and 82A of the bottom panel 11. Two arcuate openings 83 and 84 are formed adjacent to the top edge of the trapezoidal shaped push-out mounting tabs 80 and 81 respectively to facilitate the pulling of the trapezoidal mounting tabs 80 and 81 downwards out from the bottom panel 11. Four right angled cut-outs 85, 86, 87 and 88 are formed at the four corners of the bottom panel 11. These right angled cut-outs have dimensions equal to the dimensions of the right angled mounting tabs formed at the inner corners of the top panels 36 and 45 of the left and right support casings.

Two rectangular longitudinal side panels 89 and 90 extend outwards from the longitudinal side edges 91 and 92 respectively of the bottom panel 11; and two longitudinal outer side panels 93 and 94 extend outwards from double foldable edges 95 and 96 of the longitudinal side panels 89 and 90 respectively. The rectangular longitudinal side panels 89 and 90 and the longitudinal outer side panels 93 and 94 have the same height. Two spaced engagement slots 97 and 98 are formed at the middle portion of the edge portion of the bottom panel 11, and two spaced engagement slots 99 and 100 are formed at the middle portion of the edge portion of the bottom panel 11. Two spaced engagement tabs 101 and 102 are formed at the outer edge of the longitudinal outer side panel 93 and two spaced engagement tabs 103 and 104 are formed at the outer edge of the longitudinal outer side panel 94 respectively. The engagement tabs 101 and 102 are for engagement with the engagement slots 98 and 97 for retaining the outer side panel 93 in a double folded position along the double fold edge 95 to lie juxtaposed to the longitudinal side panel 90 to form a reinforced double layer horizontal front panel 12 of the tray container, while the engagement tabs 103 and 104 are for engagement with the engagement slots 99 and 100 for retaining the outer side panel 94 in a double folded position along double fold line 96 to lie juxtaposed to the longitudinal side panel 89 to form the reinforced double layer horizontal rear panel 13 of the tray container.

A mounting slot 105 is formed at the middle portion of the edge 37 of the narrow left top panel 36, similarly a mounting slot 106 is formed at the middle portion of the edge 46 of the narrow right top panel 45. These mounting slots have a length equal to the longer side edge of the trapezoidal mounting tabs 80 and 81.

Since the components of the left case 14 are same as those of the right case 15 as described above, for simplicity of description, the assembly of the right case 15 is described below. The assembly of the corresponding components to form the left case 14 can be carried out in the same manner so as to form the entire tray container.

Figure 4:
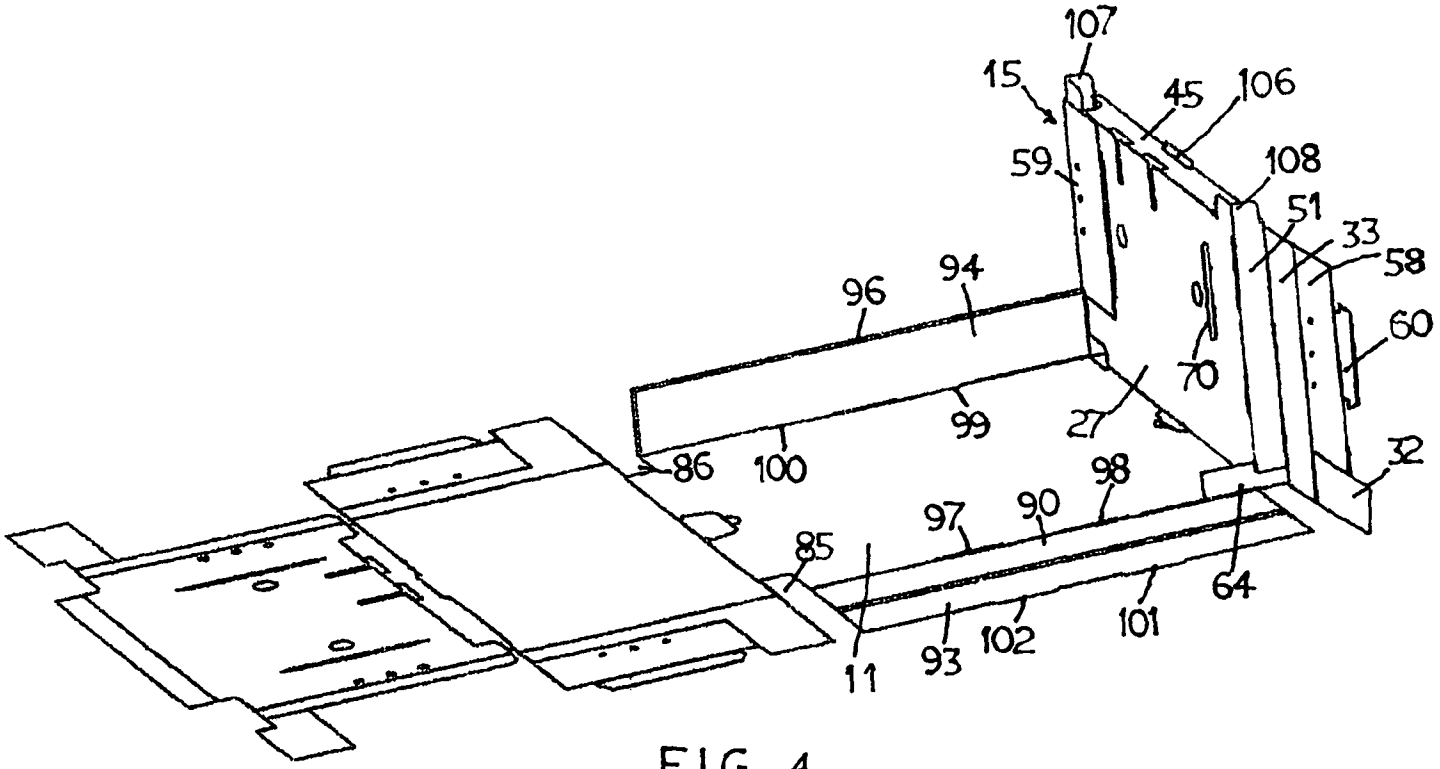
FIG. 4 is a top and front perspective elevation view showing partial assembly of the right side of the figuration of FIG. 3 to form the right casing of the tray container.
Figure 5:
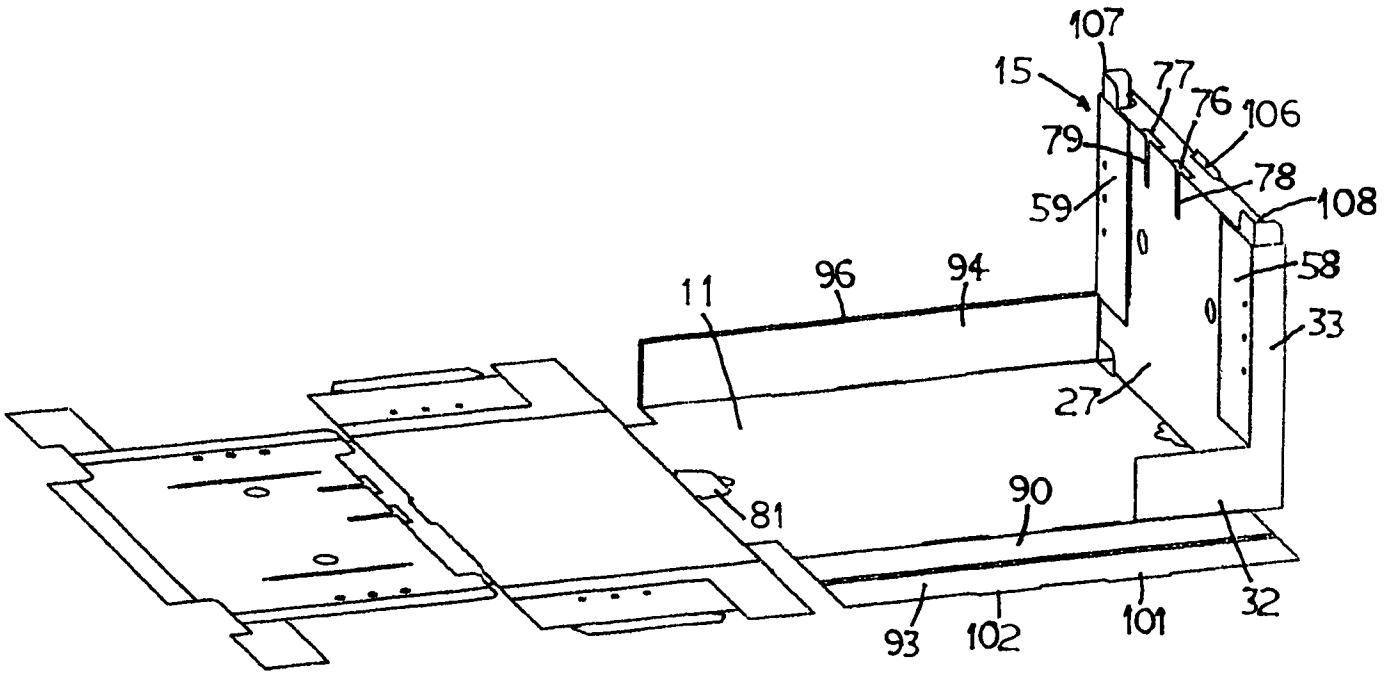
FIG. 5 is a front and top perspective elevation view showing further partial assembly of the right casing.

The right case 15 is formed in the following sequential manner. First, the abutment strip 67 and the two retaining arms 64 and 65 are bent and folded upward along the fold lines between it and the two narrow outer panels 50 and 51 are bent and folded upward to lie perpendicular to the inner side panel 27. The inner side panel 27 is then folded upwards relative to the fold line 47 to lie perpendicular to the top panel 45. The top panel 45 is folded upwards until the inner side panel 27 lies over the outer side panel 26 to form the initial form of the right case 15. The entire initial right casing thus formed above is folded and flipped to the vertical upward position as shown in FIG. 4 with the bent abutment strip 67 abutting the side edge portion of the bottom panel 11 and the completely flat right outer surface 26 of the outer side panel 26 now forming the outer side panel of the tray container and the inner side panel 27 now forming the inner side panel of the tray container. Two right-angled mounting tabs 107 and 108 will now extend upwards from the two inner corners of the top panel 45 of the right case 15. One side of the right-angled mounting tabs 107 and 108 extends upwards from the narrow outer panels 50 and 51, and another side of the tabs extends upwards from an end edge portion of the inner side panel of the tray container whereby the right-angle of the right-angled mounting tabs 107 and 108 is facing away from the interior of the mounting tray. The retaining arms 64 and 65 are bent and folded to lie over the corner edge portion of the edge 91 of the bottom panel 11 and the two narrow outer panels 50 and 51 forming the vertical side edges of the right case 15 as partially shown in FIG. 4. The L-shaped extension panels 28 and 29 are then folded with their longer arm portions 33 and 35 lying juxtaposed with the vertical side edges of the right case 15 to form a double reinforced layer of the right vertical side portion 109 of the front panel of the tray container 10. The shorter arm portions 29 and 32 will now lie also at the corner edge portion of the edge 92 and 91 respectively of the bottom panel 11 to lie juxtaposed to the retaining arms 65 and 64 respectively. The cover panels 58 and 59 are then folded to lie juxtaposed to the inner side panel 29 with the securing tabs 60 and 61 bent and inserted into the mounting slots 70 and 71 to secure them firmly in the mounted position with the L-shaped extension panels 28 and 29 and the cover panels 58 and 59 wrapping tightly around the vertical side panels and edge portion of the inner side panel of the case 15 to reinforced the rigidity of the upstanding right angled mounting tabs 107 and 108 as best shown in FIG. 5. The short portion 32 of the L-shaped front panel 28 together with the securement arm 64 are tightly sandwiched within the right edge portion of the double folded front panel 12 of the tray container. Two rectangular bottom mounting openings 110 and 111 are inherently formed at the bottom panel 11 with the formation of the right case 15. When two tray containers are stacked one on top of the other, these bottom mounting openings 110 and 111 of the tray container located on top will engage snugly with the upstanding right angled mounting tabs 107 and 108 of the tray container located at the bottom of the stack.

The left case 14 may be assembled in the same manner as the right case 15 having all the similar components to the right case as described above to form the complete tray container of the present invention. Two rectangular bottom mounting openings 112 and 113 are inherently formed at the left corners of the bottom panel 11 with the formation of the right case 14, and two right-angled upstanding mounting tabs 114 and 115 formed at the inner corners of the top panel 36 of the left case 14. Thus, all mounting tabs 107, 108, 114 and 115 of both the left case and the right case all have their angle facing away from the interior of the tray. The mounting openings 110, 111, 112 and 113 have dimensions equal to the right-angled mounting tabs 107, 108, 114 and 115.

Two openings 116 and 117 are formed in the left inner side panel 17 and two openings 118 and 119 are also formed in the right inner side panel 27 to facilitate the assembly of the left case 14 and the right case 15 with fingers inserted into these openings.

Figure 6:
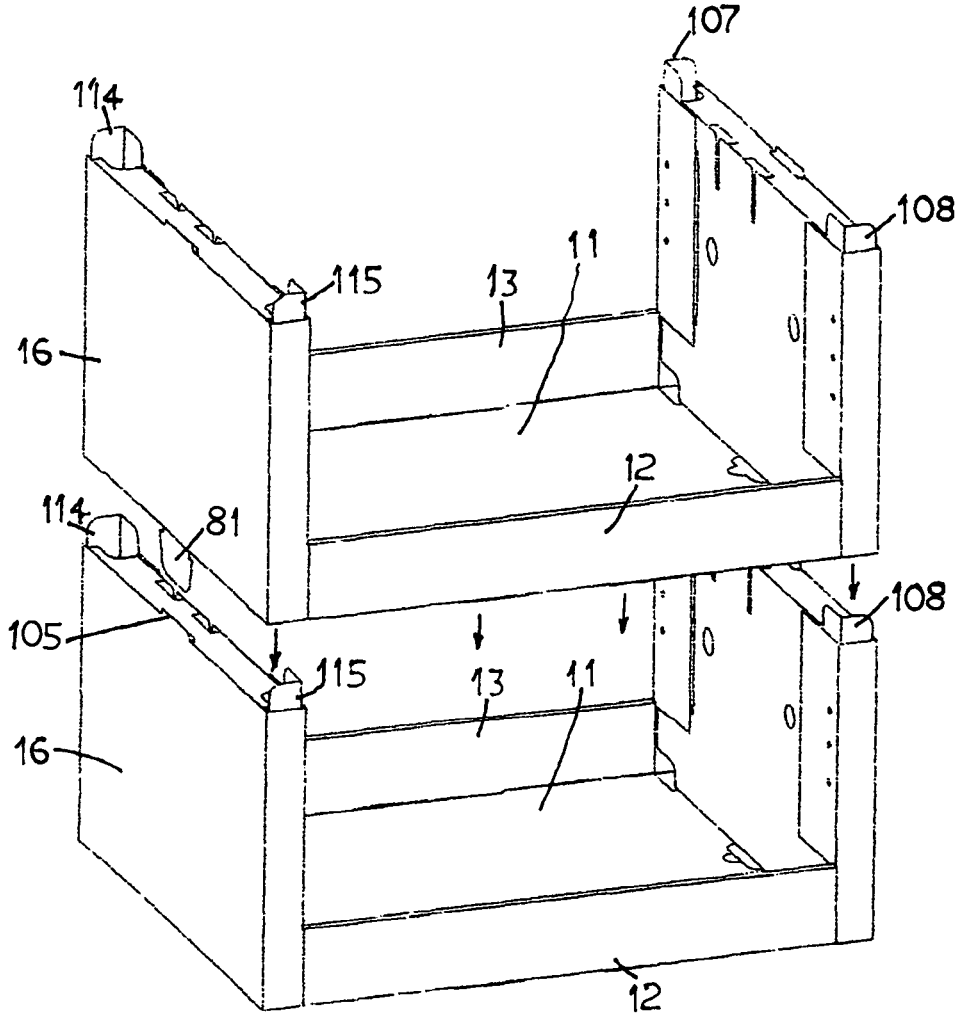
FIG. 6 is a front and top perspective elevation view showing the stacking of two tray containers of the present invention together.
Figure 7:
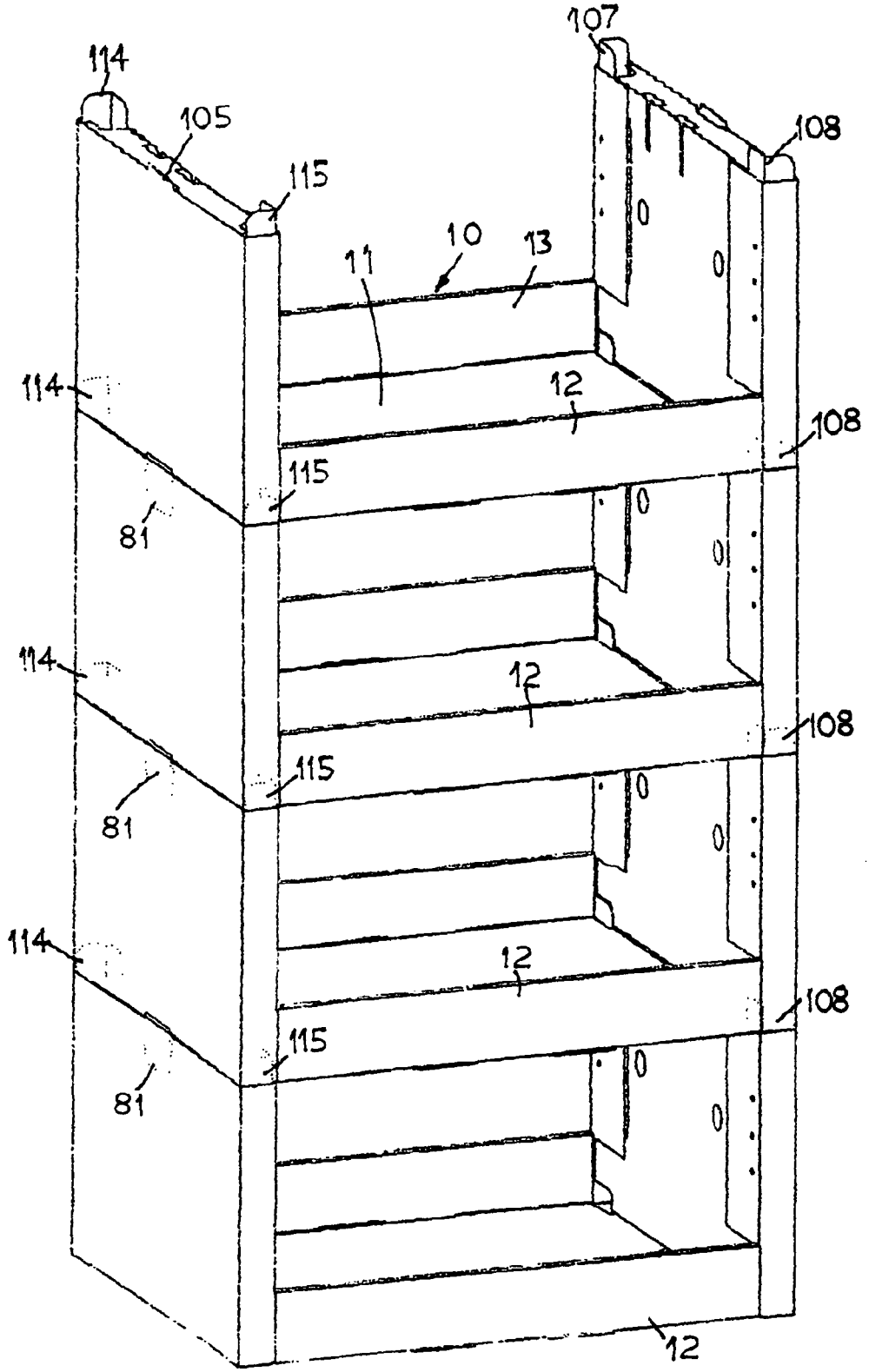
FIG. 7 is a front and top perspective elevation view showing a plurality of tray containers stacked together.
Figure 8:
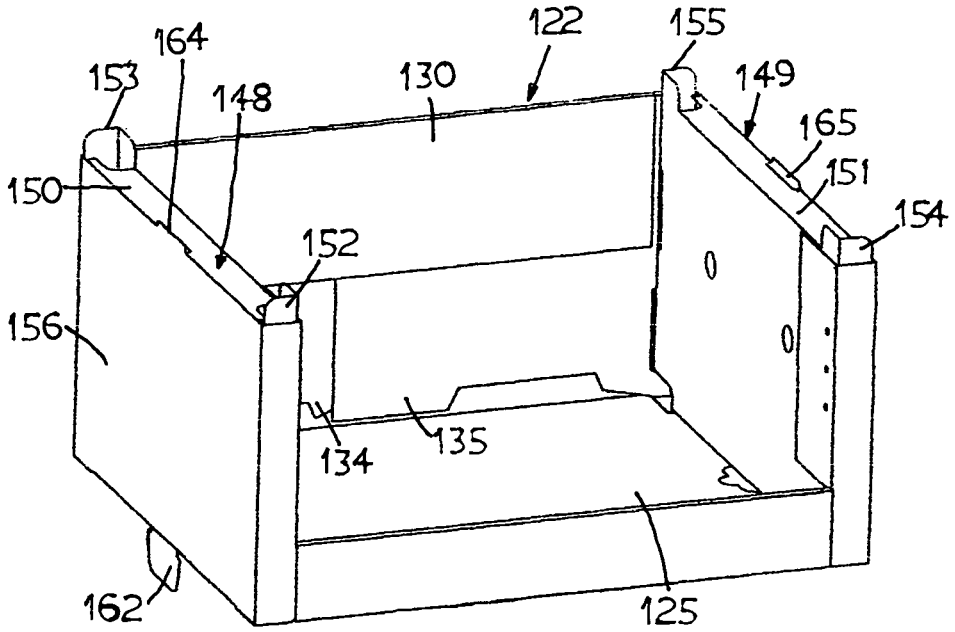
FIG. 8 is a front and top perspective elevation view of a second embodiment of the tray container according to the present invention having and open front and a closed rear.

Two tray containers 10 of the present invention may be mounted in a stack manner as best shown in FIG. 6 with the right-angled upstanding mounting tabs 107,108,114, and 115 of the tray container at the bottom engaging snugly with the rectangular openings 110, 111, 112 and 113 at the bottom of the bottom panel of the tray container at the top. With the location of the right-angled mounting tabs 107, 108, 114 and 115 at the inner corners of the bottom tray container as well as the reinforcement of the cover panels, the stack can withstand a high external front and side impacts without deforming the right-angled mounting tabs or to cause dislodgement of the securement between the stacked tray containers, because the external impact would urge the cover panels more tightly against the inner panels.

As shown in FIG. 6, the trapezoidal pull-out mounting tabs 80 and 81 at the bottom panel of the tray container at the top may also be pulled out and inserted into the mounting slots 105 and 106 formed at the top panels 36 and 45 of the tray container at the bottom to provide additional securement between the two tray containers stacked together and to withstand high external lateral impacts to the stack.

Longitudinal partitions may be provided in the tray container for dividing the interior space of the containers into separate front and rear compartments or areas to separate two different merchandise items which are separately accessible from the open front or the rear of the tray container. The partitions are provided with end hooks at their upper corners for slidably inserting into the slots 74, 78 and slots 75, 79 located at directly opposite positions of the left case 14 and right case 15 respectively to be securely mounted in place.

Figure 9:
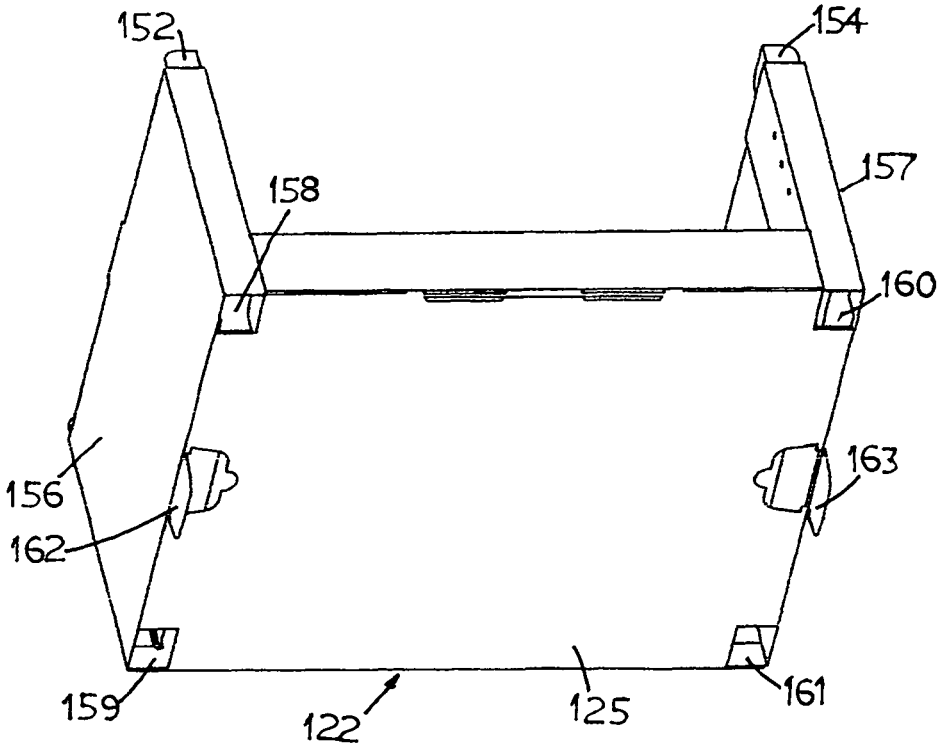
FIG. 9 is a front and bottom perspective elevation view of the second embodiment of the tray container according to the present invention.
Figure 10:
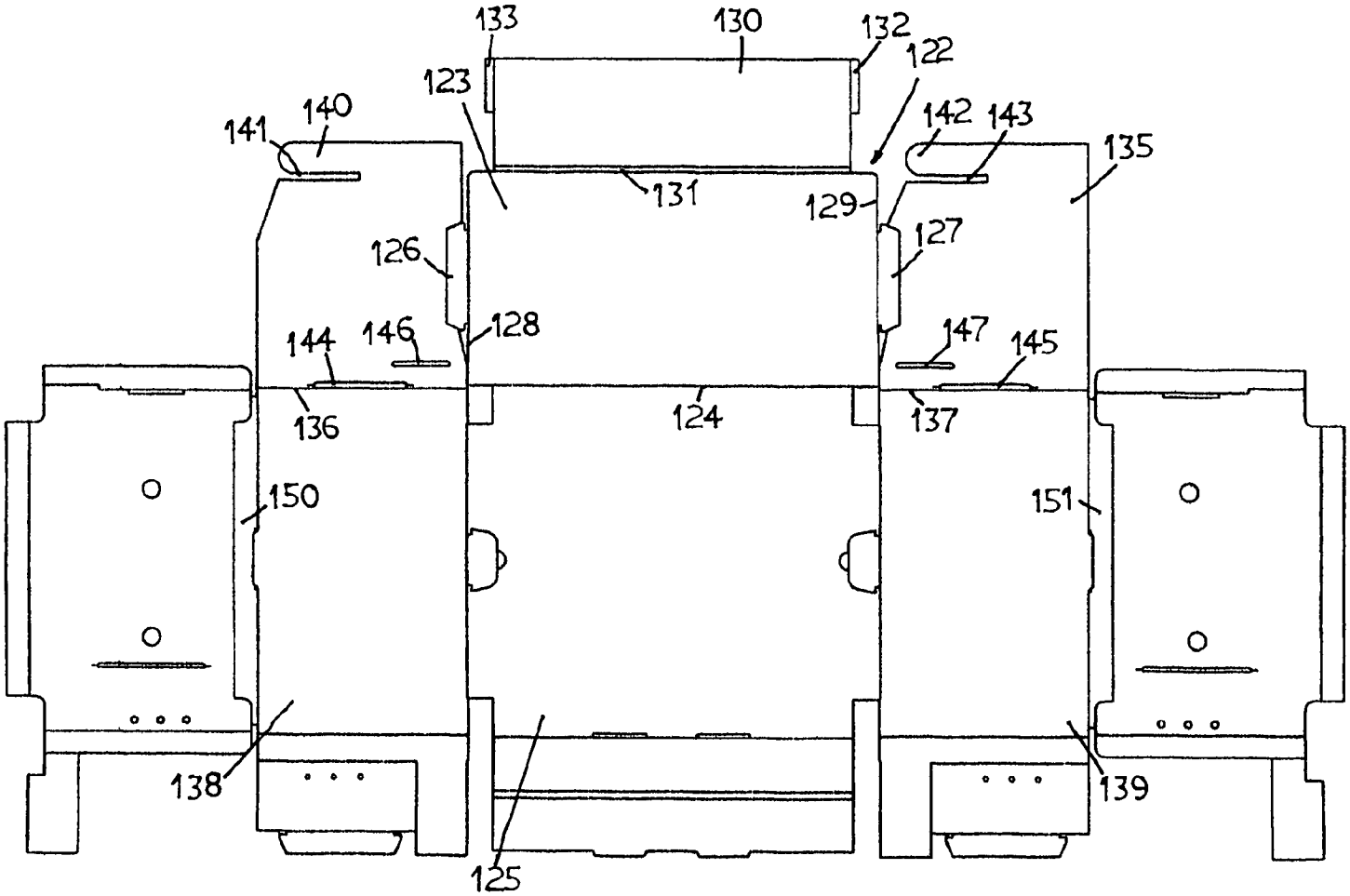
FIG. 10 is a top perspective elevation of the geometrical figure provided on a single cardboard stock which is foldable to form the second embodiment of the tray container of the present invention.
Figure 11:
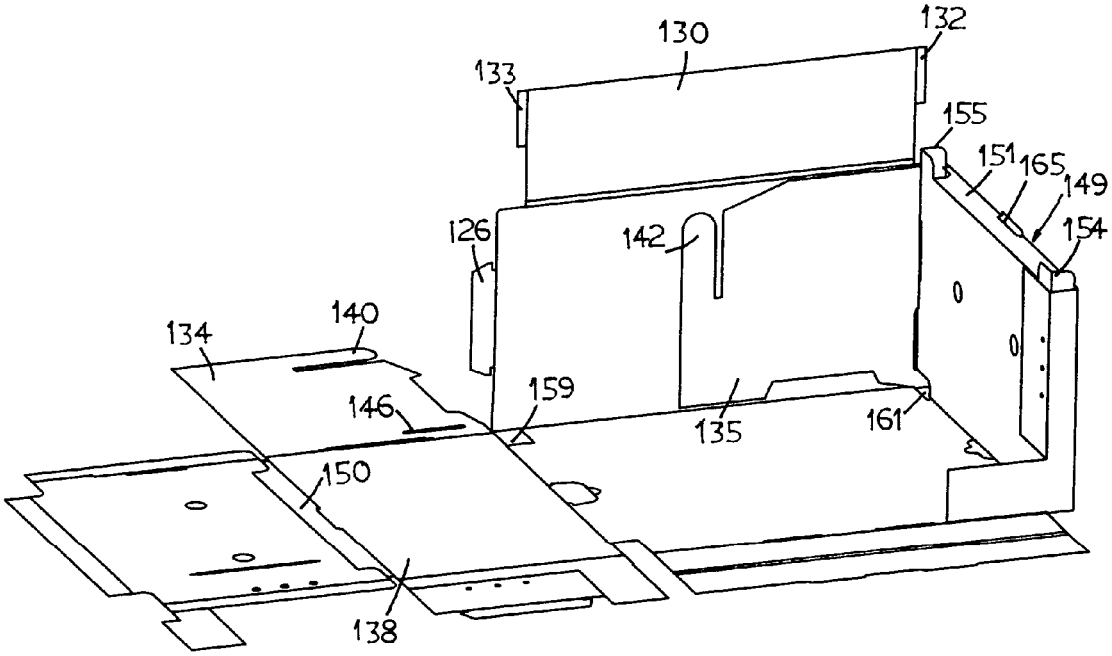
FIG. 11 is a front and top perspective elevation view of the second embodiment of the tray container according to the present invention with the right side of the geometrical figure partially assembled to form the right casing of the tray container.

A second embodiment of the tray container of the present invention is shown in FIGS. 8 through 13. The tray container 122 of the second embodiment has a closed rear panel. It can be fabricated with the geometrical figure as shown in FIG. 10 provided on a single cardboard or corrugated board stock similar to that of FIG. 3. For simplicity of description, only the differences in construction between the two embodiments, namely the different rear panel, is described below. A rectangular rear panel 123 having dimensions for covering the entire rear side of the tray container 122 including the rear side panel of the left and right casings is provided. The rear panel 123 extends rearward from the upper edge 124 of the rectangular bottom panel 125 and it is foldable relative to the bottom panel 125 along the edge 124. Two side mounting tabs 126 and 127 are formed at the middle portion of the side edges 128 and 129 of the rear panel 123. A reinforcing rectangular panel 130 extends outwards from an upper double fold edge 131 of the rear panel 123. Two side securement tabs 132 and 133 are formed at the upper edge portion of the side edges of the reinforcing rectangular panel 130. A left rear covering panel 134 and right rear covering panel 135 having a width equal to the height of the rear panel 123 extend outward from an upper edge 136 and 137 respectively of the left outer panel 138 and right outer panel 139. The left rear covering panel 134 is foldable along edge 136 relative to the left outer panel 138 and the right covering panel 135 is foldable along edge 137 relative to the right outer panel 139. A hook portion 140 is formed at the upper left side of the left rear covering panel 134 with an open end slot 141 formed therein adjacent to the upper edge of the left rear covering panel 134. A hook portion 142 is formed at the upper left side of the left rear covering panel 135 with an open end slot 143 formed therein adjacent to the left upper edge of the right rear covering panel 135. Two mounting slots 144 and 145 are formed respectively in the left rear covering panel 134 and right rear covering panel 135 at the middle of the edges 136 and 137 respectively. The mounting slots 144 and 145 have a length equal to the length of the mounting tabs 126 and 127 respectively. A securement slot 146 is formed in the left covering panel 134 and located at the right corner therein at a short distance from the edge 136. A securement slot 147 is formed in the right covering panel 135 and located at the left corner therein at a short distance from the edge 137. The securement slots 146 and 147 have a length equal to the length of the securement tabs 132 and 133 respectively.

The tray container of the second embodiment may be assembled in the following steps. The components of the left and right cases 148 and 149 are similar to those of the left and right cases 14 and 15 of the above embodiment are folded in the same manner. Then, the covering panels 134 and 135 are folded upward along edges 136 and 137 of the left and right outer panels 138 and 139 respectively to abut the rear panels 150 and 151 of the left and right cases 148 and 149. The partially assembled left and right cases are then bent and flipped to the position perpendicular to the bottom panel 125 similar to that in the above embodiment, while slidably engaging the hook portions 140 and 142 of the covering panels 134 and 135 together to maintain the left and right cases firmly positioned in the vertical manner at the two side edge portions of the bottom panel 125 as partially shown in FIG. 11. The rear panel 123 will be folded upwards to lie in abutment with the rear surface of the now secured together covering panels 134 and 135 to form the closed rear side of the tray container. The rear panel 123 is secured firmly in the vertical position with the side mounting tabs 126 and 127 folded forward and inserted into the mounting slots 144 and 145 respectively. The reinforcing rectangular panel 130 can now be folded forward along the double fold edge 131 to lie juxtapose to the upper portion of the covering panels 134 and 135 with the side mounting tabs 132 and 133 inserted into the mounting slots 146 and 147 respectively of the covering panels 134 and 135. Thus, the second embodiment of the tray container is formed having left case 148 and a right case 149 with top panels 150 and 151 respectively therein; upstanding right angled mounting tabs 152, 153, 154, and 155 extending upward at the inner corners of the top panels 150 and 151 and located adjacent to the interior of the tray container. The outer surface of the outer panel of the left casing 148 forms the completely flat outer surface 156 of outer side panel the tray container; and the outer surface of the outer panel of the right case 149 forms the completely flat outer surface 157 of the outer side panel of the tray container.

Figure 12:
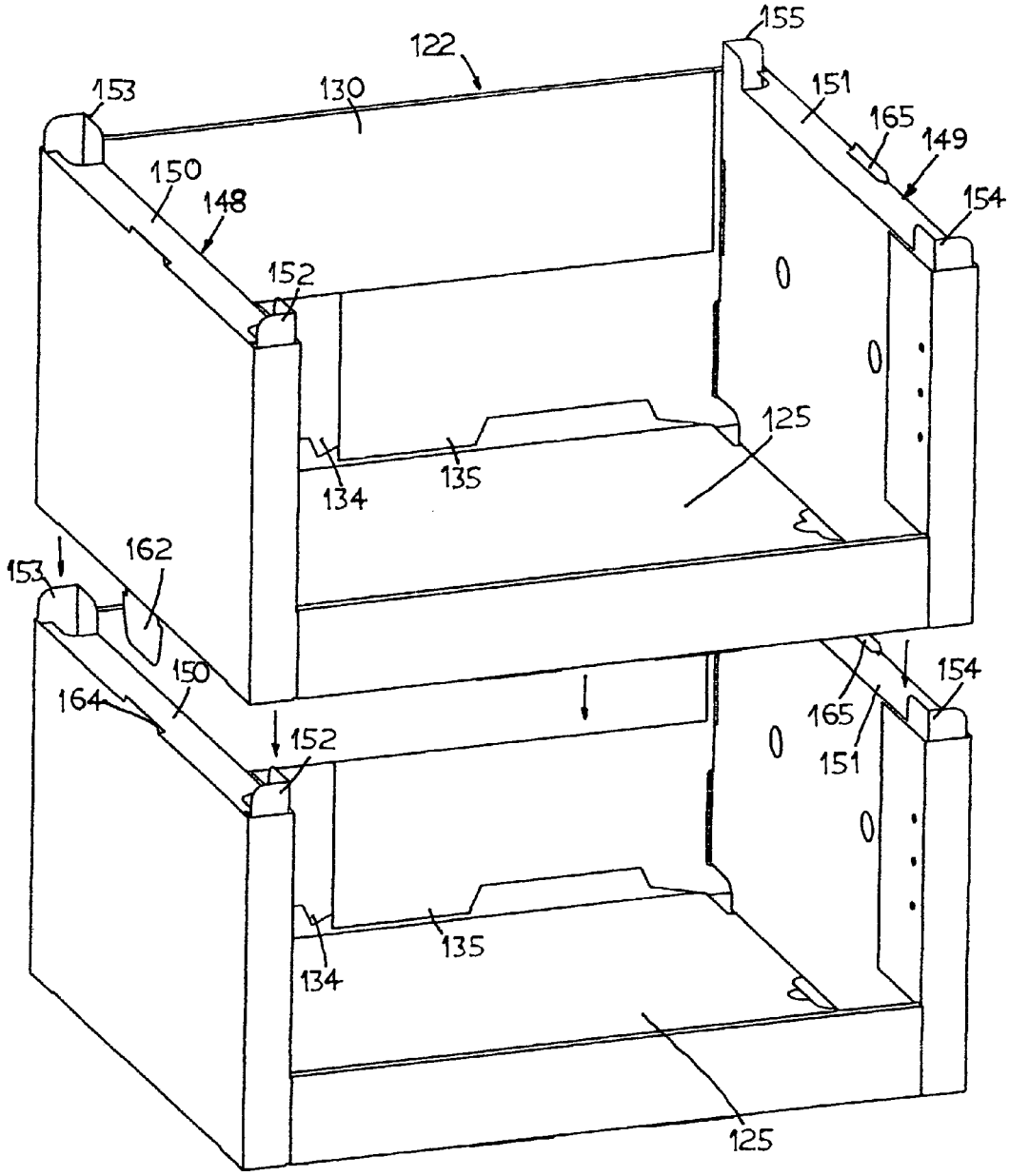
FIG. 12 is a front and top perspective elevation view showing the stacking of two tray containers of the second embodiment together.

Four rectangular mounting openings 158, 159, 160 and 161 are invariably formed at the bottom of the bottom panel 125 which will engage with the upstanding right angled mounting tabs 152, 153, 154 and 155 when two tray containers of the second embodiment are to be stacked together as shown in FIG. 12.

Two pull-out trapezoidal shaped mounting tabs 162 and 163 are formed in the bottom panel 125 which may be pulled downward to lie perpendicular to the bottom panel 125 as shown in FIGS. 9 and 12, so that these trapezoidal shaped mounting tabs in a tray container located at top may engage by inserting into mounting slots 164 and 165 formed at the top panels 148 and 149 respectively of the tray container located at the bottom when two tray containers are stacked together to provide additional securement between the two tray containers to withstand external accidental impact to the stack.

Figure 13:
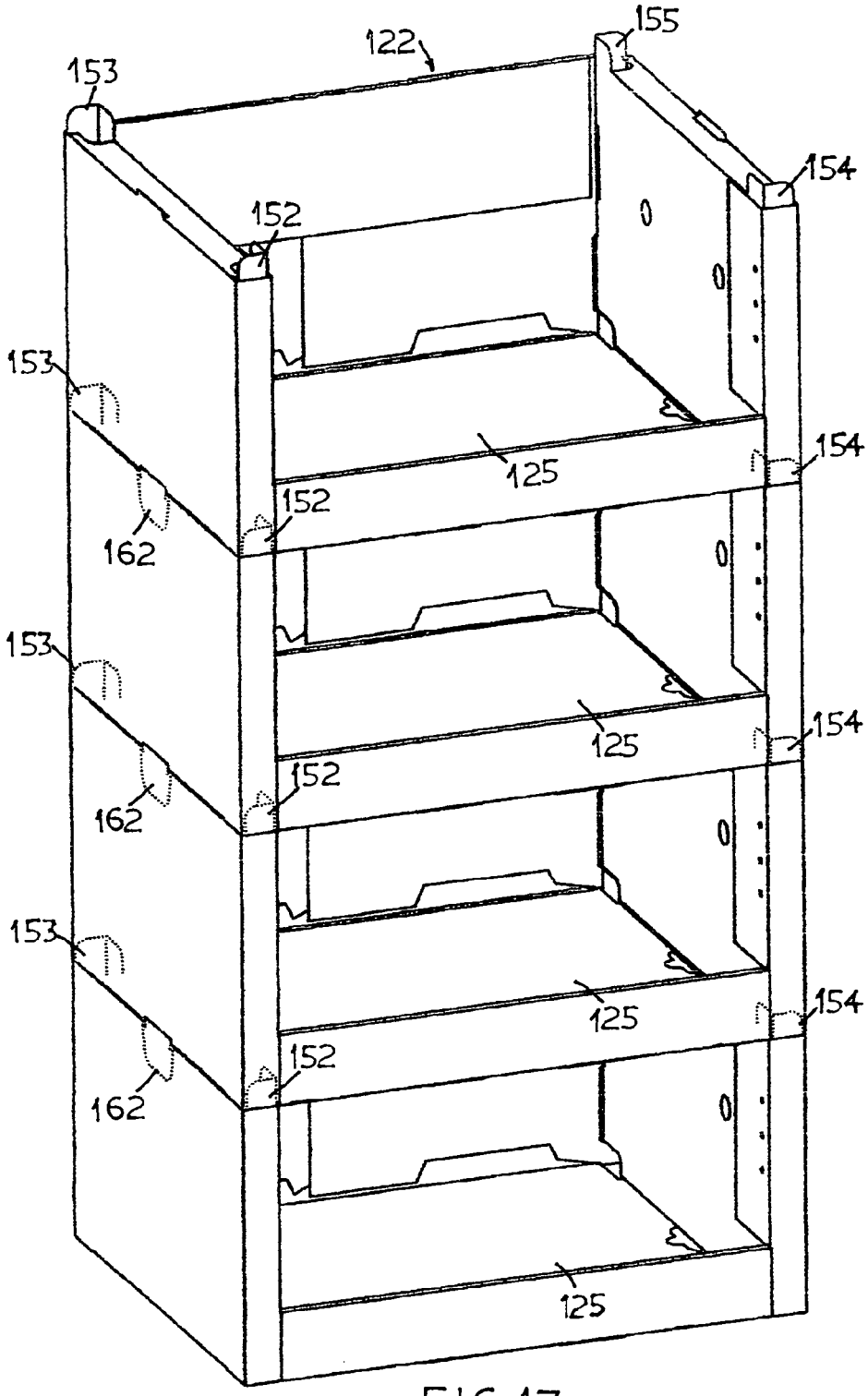
FIG. 13 is a front and top perspective elevation view of a plurality of the tray container of the second embodiment stacked together according to the present invention.

A plurality of the tray container of the second embodiment may be stacked together as shown in FIG. 13.

Figure 14:
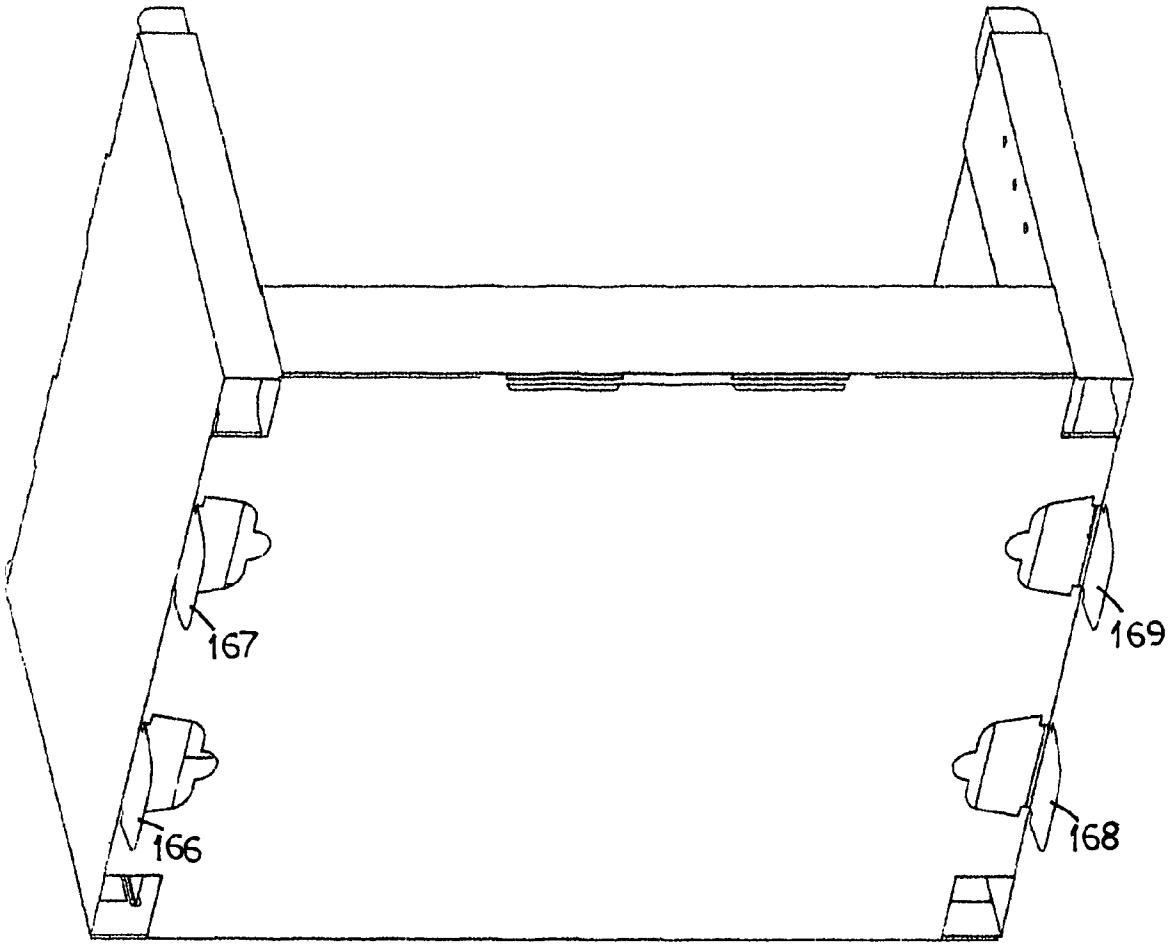
FIG. 14 is a bottom and front perspective elevation view showing the alternative formation of two trapezoidal mounting tabs at the bottom edges of the tray container of the present invention.

Two pull-out trapezoidal mounting tabs 166, 167 and 168, 169 may be alternatively provided at the side edge portions of the bottom panel of the tray container as shown in FIG. 14 together with complementary mounting slots formed at the top panels of the tray container, so as to provide still additional securement between two tray containers stacked together to withstand accidental external impact to the stack.

While there is described above the exemplary embodiments of the present invention, it is to be clearly understood that the description is made only by way of example and not as a limitation to the scope of this invention.

What is claimed is:

1. A stackable generally U-shaped merchandise tray container comprising, a rectangular bottom panel having a left side edge, a right side edge, a rear side edge, and a front side edge, a rectangular weight supporting left case and a rectangular weight supporting right case extending vertically upward at said left side edge and said right side edge respectively of said bottom panel, said left case and said right case having an outer vertical panel with a completely flat surface forming left and right outer side panels respectively of said tray container, each of said left case and said right case having a rectangular top panel, and a vertical interior panel, and narrow side panels aligned with said rear side edge and said front side edge of said tray container, two vertical right-angled mounting tabs located at two inner corners of said rectangular top panel of both said left case and said right case, with one side of said tabs extending upwards from said narrow side panels and another side of said tabs extending upwards from an end edge portion of said interior panel of said left case and said right case to locate immediately adjacent to the interior space of said tray container whereby the right-angle of all said right-angled mounting tabs is facing away from the interior of said tray container, four rectangular mounting openings formed at four corners of said bottom panel to provide a rectangular left front mounting opening, a rectangular left rear mounting opening, a rectangular right front mounting opening, and a rectangular right rear mounting opening, each of said rectangular mounting openings having one inner side edge perpendicular to a side edge of said bottom panel and a second inner side edge perpendicular said one inner side edge, said mounting openings having dimensions complementary to dimensions of said right-angled mounting tabs, whereby two tray containers are stackable one on top of another with said right-angled mounting tabs of the tray container located at the bottom of the stack engaging snugly with said one inner side edge and said second inner side edge of said rectangular mounting openings at the bottom panel of the tray container located at the top of the stack for securing the two tray containers firmly together.

2. A stackable generally U-shaped merchandise tray container according to claim 1 wherein each of said left case and said right case has a front side wall and a rear side wall extending vertically at a side edge portion of said front edge and said rear edge respectively of said bottom panel, said front side wall and said rear side wall of said left case and said right case being a vertical front extension panel and a vertical rear extension panel respectively of said interior panel, and said outer panel of said left case and said right case have a extension cover panel having a portion therein folded and covering over said front side wall of said left case to form vertical double layer left front side panel and right front side panel of said tray container, and an end portion of said extension cover panel being folded and covering over a vertical front portion of said interior panel, and a vertical mounting tab formed at a free end edge of said end portion of said extension cover panel being secured to a vertical mounting slot formed in said interior panel.

3. A stackable merchandise tray container according to claim 2 wherein said interior panel of each said left case and said right case has a front retaining arm portion extending along a left edge portion and a right edge portion respectively of said front side edge of said bottom panel, and said outer panel of said left case and said right case have a front side arm portion extending also along said front side edge respectively of said bottom panel and lying juxtaposed to said front retaining arm portion of said interior panel, and a double folded rectangular front panel extending between said vertical left front side panel and said right front side panel, said front retaining arm portion of said interior panel and said front side arm portion of said outer panel being sandwiched in a left side edge portion and a right side edge portion respectively of said front panel of said tray container.

4. A stackable merchandise tray container according to claim 3 wherein said front panel includes a rectangular front extension panel extending from said front side edge of said bottom panel, and an additional rectangular panel extending from a double foldable edge of said front extension panel, two spaced edge mounting tabs formed at a free edge of said additional rectangular panel, two spaced mounting slots formed at said front side edge of said bottom panel, said front extension panel being folded upward to form a front wall of said front panel of said tray container, said additional rectangular panel being double folded inward along said double fold edge to lie juxtaposed to inner surface of said front extension panel, and said mounting tabs being inserted into said mounting slots to maintain said front panel in a mounted position, said front panel having a height lower than said left front side panel and said right front side panel of said tray container.

5. A stackable merchandise tray container according to claim 4 including a top mounting slot formed at said top panel adjacent a common edge with said interior panel of each of said left case and said right case, a pull-out trapezoidal mounting tab formed at an edge portion of both left and right side edges of said bottom panel, said pull-out trapezoidal mounting tab being pullable outward to lie vertically downward from said bottom panel, said trapezoidal mounting tab having a width equal to length of said mounting slot at said top panel, whereby when two tray container are stacked one on top of another, said trapezoidal mounting tabs of the top tray container are engageable with said top mounting slot of the bottom tray container for providing additional securement between the two tray container stacked together.

6. A stackable merchandise tray according to claim 5 wherein said interior panel of each said left case and said right case has a rear retaining arm portion extending along a left edge portion and a right edge portion respectively of said rear side edge of said bottom panel, and said outer panel of said left case and said right case have a rear side arm portion extending also along said rear side edge respectively of said bottom panel and lying juxtaposed to said rear retaining arm portion of said interior panel, and a double folded rectangular rear panel extending between said vertical left rear side panel and said right rear side panel, said rear retaining arm portion of said interior panel and said rear side arm portion of said outer panel being sandwiched in a left side edge portion and a right side edge portion respectively of said rear panel of said tray container.

7. A stackable merchandise tray according to claim 6 including at least one pull-out trapezoidal mounting tab formed at an edge portion of said left side edge and said right side edge of said bottom panel respectively, and a top mounting slot formed in said top panel of said left case and said right case respectively, said trapezoidal mounting tab being engageable with said top mounting slot for providing additional securement between two tray containers stacked one on top of another.

8. A stackable merchandise tray according to claim 7 including at least one trapezoidal mounting tab formed at an edge portion of said left side edge and said right side edge respectively of said bottom panel, and a top mounting slot formed in said top panel of said left case and said right case respectively, said trapezoidal mounting tab being engageable with said top mounting slot for providing additional securement between two tray containers stacked together one on top of another.

* * * * *